United States Patent [19]

Lehmann et al.

[11] Patent Number: 5,041,048

[45] Date of Patent: Aug. 20, 1991

[54] MULTIPLE GRAPHICS SELECTION TOY

[76] Inventors: Roger W. Lehmann, 18 Flintlock Ct., Bernardsville, N.J. 07924; Michael I. Satten, 26 Cow La., Kings Point, N.Y. 11024

[21] Appl. No.: 600,302

[22] Filed: Oct. 19, 1990

[51] Int. Cl.[5] ..... A63H 1/00; A63H 1/28; A63H 13/16; A63H 13/00

[52] U.S. Cl. ..... 446/236; 446/265; 446/310; 446/357; 273/281; 40/492

[58] Field of Search ..... 446/234, 236, 238, 246, 446/265, 266, 268, 297, 303, 308, 309, 310, 311, 321, 330, 332, 352, 357, 359, 360, 491, 1, 4, 5, 6; 273/281; 40/446, 492

[56] References Cited

U.S. PATENT DOCUMENTS

| | | | |
|---|---|---|---|
| 1,651,244 | 11/1927 | Becker | 446/238 |
| 2,646,646 | 7/1953 | Glass | 446/1 X |
| 2,768,471 | 10/1956 | Fusselman | 446/1 |
| 2,774,179 | 12/1956 | Zalkind | 446/1 |
| 3,538,620 | 11/1970 | Kohner et al. | 446/297 X |
| 3,768,199 | 10/1973 | Goldfarb | 446/357 |
| 4,136,883 | 1/1979 | Klees | 273/281 |
| 4,244,568 | 1/1981 | Ferris et al. | 446/246 X |
| 4,353,701 | 10/1982 | Greenberg | 446/308 X |
| 4,568,304 | 2/1986 | Santa Maria | 446/330 X |

FOREIGN PATENT DOCUMENTS

| | | | |
|---|---|---|---|
| 0237119 | 9/1987 | European Pat. Off. | 273/281 |
| 2584301 | 1/1987 | France | 273/281 |
| 352221 | 3/1961 | Switzerland | 446/303 |
| 2063084 | 6/1981 | United Kingdom | 446/238 |

*Primary Examiner*—D. Neal Muir
*Attorney, Agent, or Firm*—Samuel J. Stoll

[57] ABSTRACT

A multiple graphics selection toy having a plurality of graphics-bearing elements that are individually rotatable between a position in which the graphics are concealed and a position in which the graphics are revealed, and having a manually operable selector control by which an individual graphics-bearing element is moved from either of the positions to the other. The graphics may be two or three-dimensional representations of animals and other characters of interest to children.

12 Claims, 7 Drawing Sheets

Fig. 9.
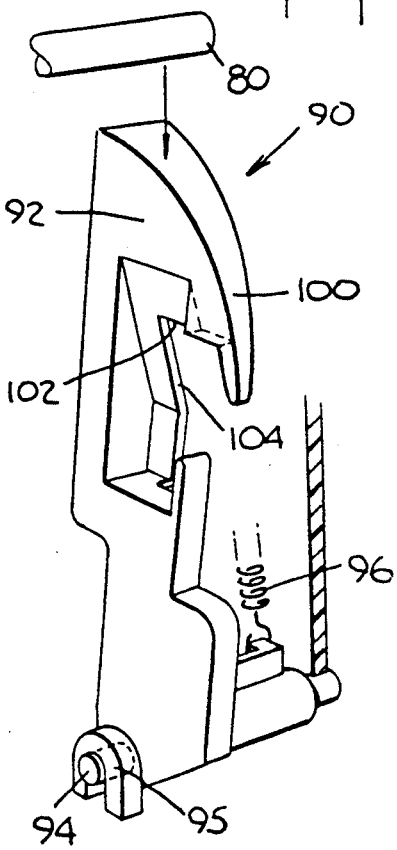
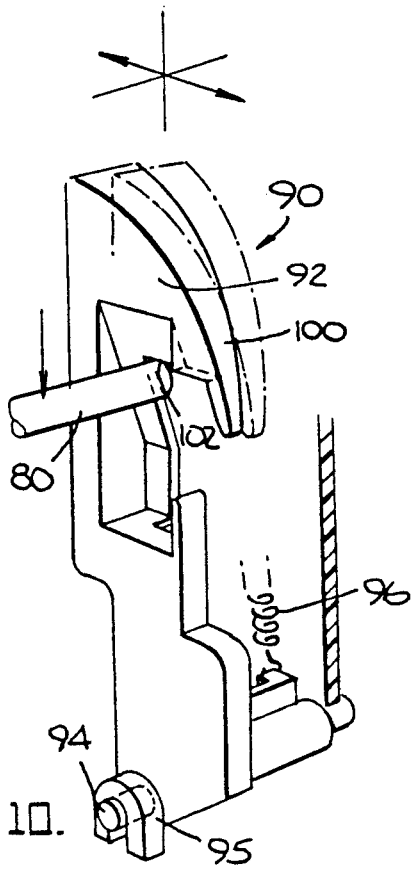
Fig. 10.
Fig. 11.
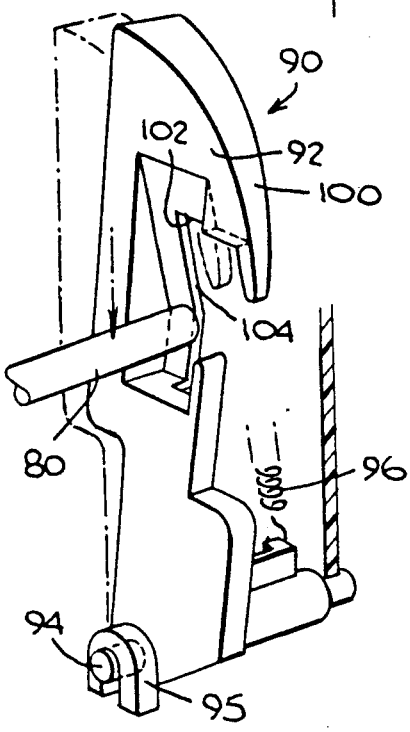
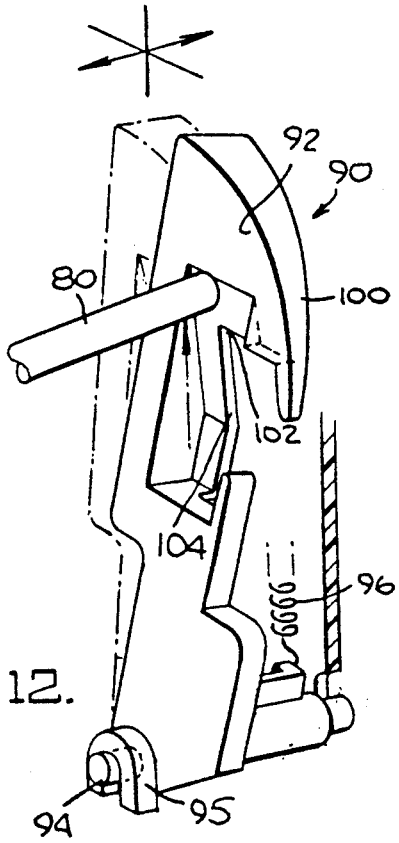
Fig. 12.

MULTIPLE GRAPHICS SELECTION TOY

BACKGROUND OF THE INVENTION

1. Field of the Invention

This invention is in the field of multiple-graphics toys having individual graphics selection means.

2. Prior Art

The closest prior art known to applicants consists of the following U.S. patents:

U.S. Pat. No. 2,449,116 Hatchett
U.S. Pat. No. 3,462,153 Giraud et al.
U.S. Pat. No. 3,538,620 Kohner et al.
U.S. Pat. No. 3,894,353 Oguchi These patents show toys having a plurality of figures and manual selection means (the closest is Oguchi) but they do not show graphics-bearing elements that are rotatable between a position in which the graphics are concealed and a position in which the graphics are revealed. Nor do they show a selector control that selects an individual graphics-bearing element and causes it to rotate between these two positions. In Oguchi, for example, the selector control does not reset or return an exposed figure to concealed position. This is done in Oguchi by manually pushing the exposed figure back into concealed position.

SUMMARY OF THE INVENTION

The broad objective of the present invention is an action toy of interest to, and adapted for operation by, young children. Only one control is provided for the operation of the toy, a central selector control which is rotatably movable to select one of a plurality of graphics-bearing elements, and which is axially movable to rotate the selected graphics-bearing element to reveal or to conceal the graphics. The graphics may consist of two- or three-dimensional representations of animals or other characters or things that interest children.

Preferably, the graphics are three-dimensional figures of the animals or other characters occupying one side of said graphics-bearing elements, while two-dimensional pictures or names of those same animals or other characters are applied to the opposite side of said elements. Normally, the graphics-bearing elements are positioned with their two-dimensional pictures or names exposed and their three-dimensional figures concealed. By rotating the selector control and pointing it at an individual two-dimensional picture or name of an animal or other character, and then operating the selector control by pushing it axially, the selected graphics-bearing element is caused to rotate and to expose its three-dimensional figure of the selected animal or other character.

BRIEF DESCRIPTION OF THE DRAWING

FIG. 9 is an enlarged perspective of the retaining mechanism for holding a selected graphics-bearing element in rotated position, said retaining mechanism being shown in non-retaining position.

FIG. 10 is a view similar to that of FIG. 9, but showing it in retaining position.

FIG. 11 is a view similar to that of FIG. 10, but showing it in releasing position.

FIG. 12 is a view similar to that of FIG. 11, but showing it in a more advanced releasing position.

DESCRIPTION OF PREFERRED EMBODIMENT OF THE INVENTION

The outer views (FIGS. 1 and 2) of a multiple graphics selection toy 10 made in accordance with a preferred embodiment of the invention show that the toy has a housing 12, a plurality of graphics-bearing elements 14 rotatably mounted in said housing, and a central selector control 16 which is mounted on and in said housing for both rotational and axial movement relative thereto.

Figure 8:
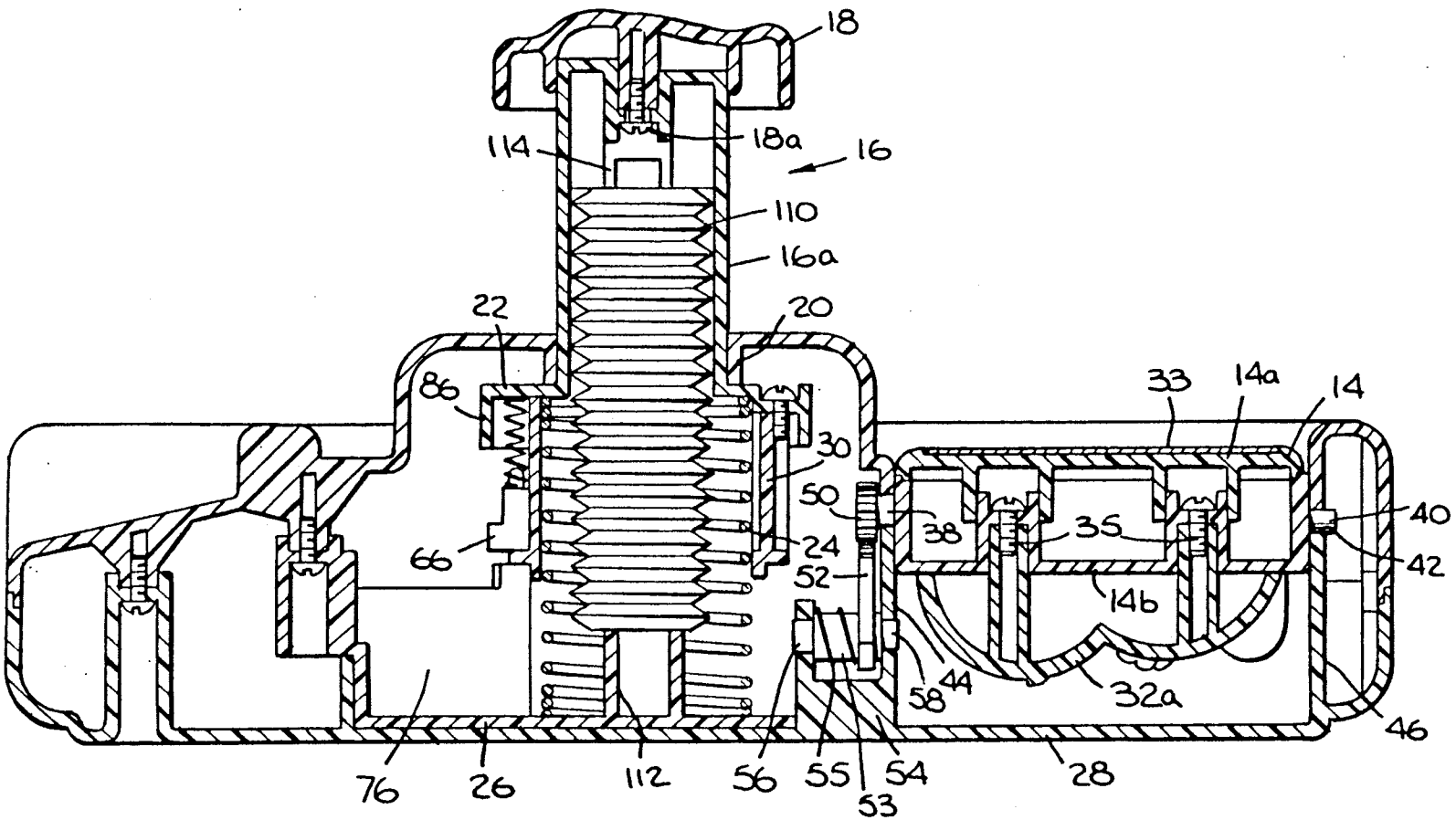
FIG. 8 is a vertical section through said embodiment on the line 8—8 of FIG. 7.

As shown in FIG. 8, housing 12 is a hollow shell containing the operative parts of the invention. Centrally located is the selector control which comprises a cylindrical element 16*a* having a cap 18 fixed thereto by means of screw 18*a*. Cylindrical element 16*a* extends through a centrally located cylindrical collar 20 formed in housing 12. Collar 20 supports cylindrical element 16*a* for axial and rotational movement relative to the housing. In this preferred embodiment of the invention the central axis of collar 20 is vertical and, consequently, so is the longitudinal axis of cylindrical element 16*a*. An annular flange 22 at the lower end of said cylindrical element is engageable with collar 20 to prevent upward displacement of said cylindrical element relative to the housing.

Annular flange 22 performs another function: it serves as an upper abutment for compression coil spring 24 which abuts a platform 26 that rests upon the bottom wall 28 of housing 12. A sleeve 30, secured to flange 22, holds said spring 24 in coaxial position relative to cylindrical element 16*a*. The function of spring 24 is to bias selector control 16 in upward direction, thereby supporting said selector control in, or returning it to, inactive position.

Figure 1:
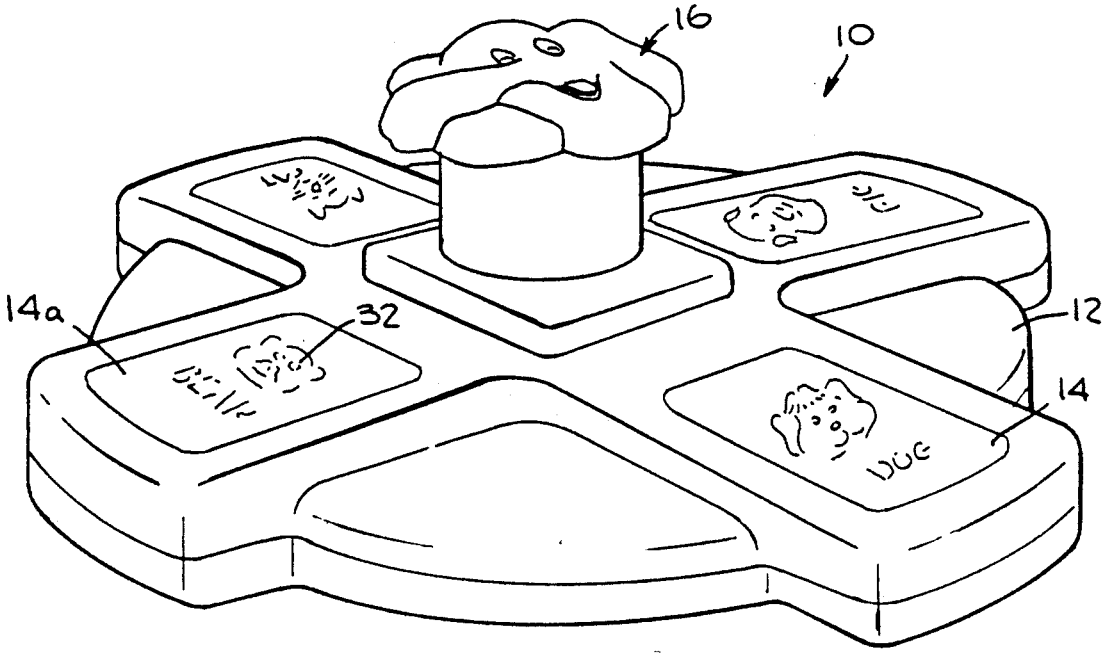
FIG. 1 is a perspective view of a multiple graphics selection toy made in accordance with a preferred embodiment of the present invention.
Figure 2:
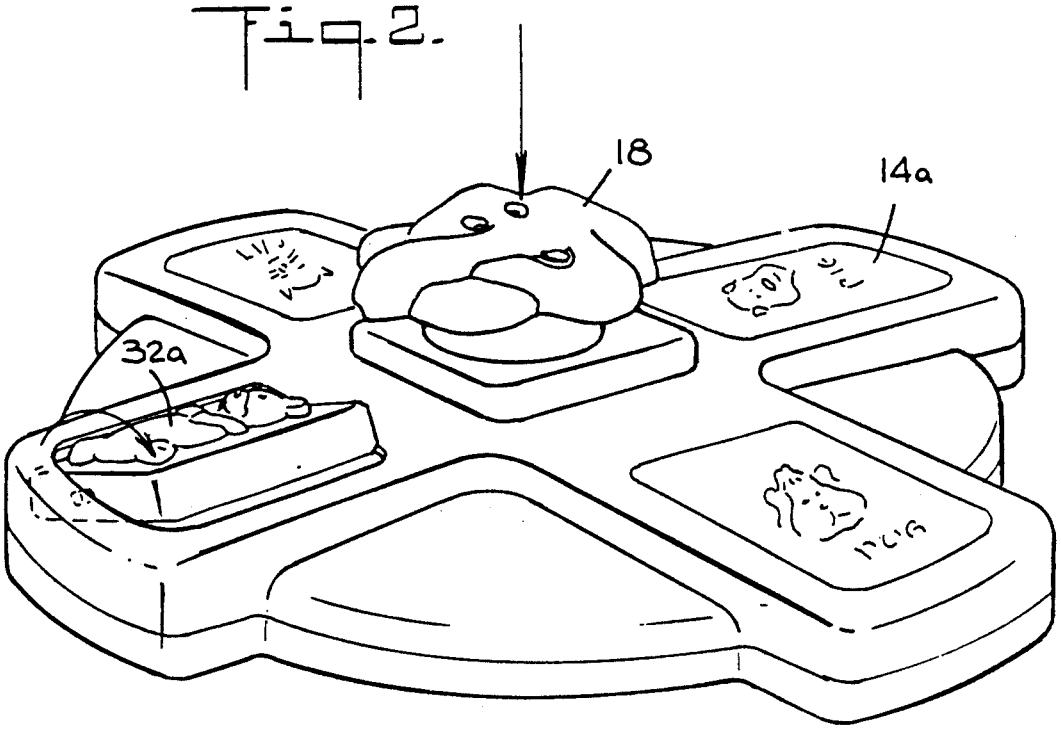
FIG. 2 is a view similar to that of FIG. 1 but showing one of the graphics-bearing elements in the process of being rotated by manual pressure applied axially to the selector control.

It will be observed in FIGS. 1 and 2 that there are four rotatable elements 14 in the illustrated embodiment of the invention. These rotatable elements are identical except in their respective graphics. Each has a two-dimensional representation, on its top wall 14*a*, of the head of an animal, e.g., the representation of a bear head 32 (see FIGS. 4 and 7). Each of the rotatable elements 14 has a three-dimensional representation on its bottom wall 14*b* of the same animal whose two-dimensional representation is on its top wall. The three-dimensional representation of a bear 32*a* is shown in FIG. 2.

Figure 3:
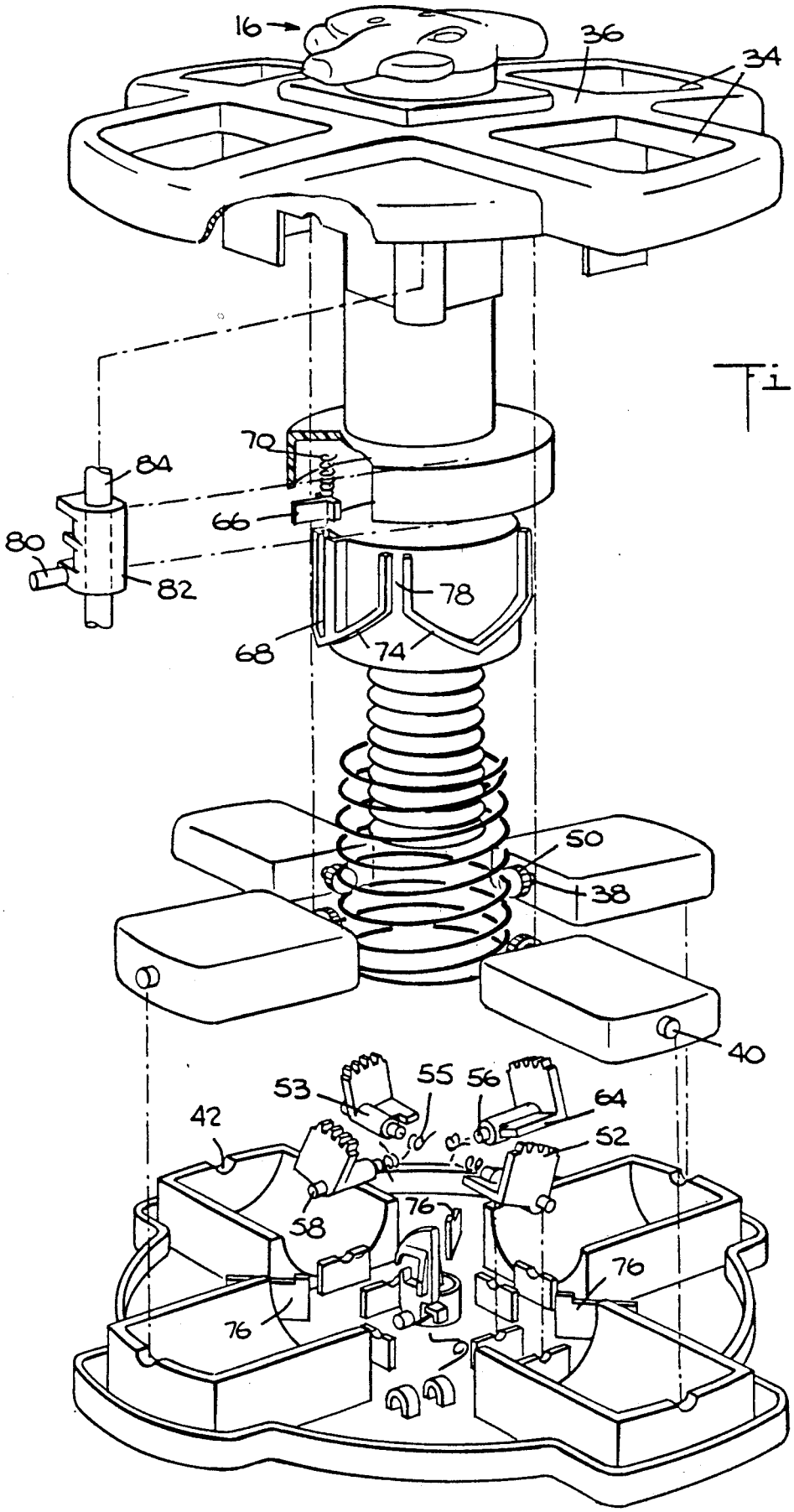
FIG. 3 is an exploded perspective view of said preferred embodiment of the invention showing its working parts.
Figure 7:
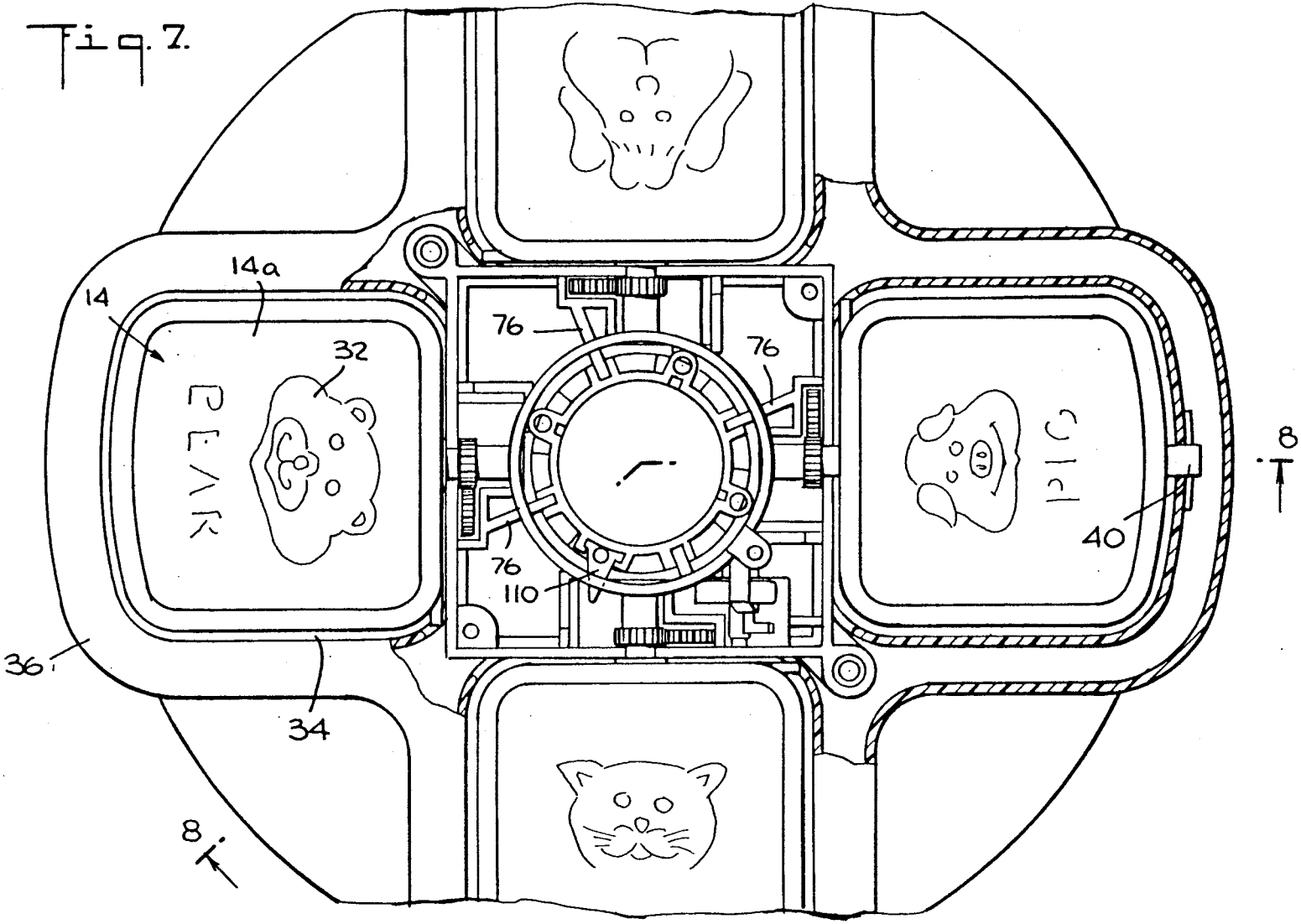
FIG. 7 is a top view of said embodiment, partly in horizontal section, showing said rotating mechanism.

It will be observed in FIGS. 3 and 7 that there are four openings or windows 34 in top wall 36 of housing 12, one for each of the four rotatable elements 14. How these rotatable elements are mounted in their respective openings or windows is best shown in FIGS. 7 and 8. Thus, each rotatable element 14 is provided at its opposite ends with journals 38 and 40 which are rotatably mounted in bearings 42 formed in vertically extending internal walls 44, 46 of housing 12.

It will be understood from FIG. 8 that a two-dimensional representation 32 may be applied directly to top wall 14*a* of each rotatable element 14 or indirectly thereto by means of label or decal 33. It will also be noted in FIG. 8 that three-dimensional representation 32*a* may comprise a hollow shell secured by means of screws 35 to rotatable element 14.

Referring now to the rotary drive means for causing rotation of the individual rotatable elements 14, it will be seen that fixed to each journal 38 is a gear 50 which functions as a driven gear. Engaging each gear 50 is a gear segment 52 which functions as a drive gear. Each gear segment 52 is supported by a drum 53 which is rotatably mounted on a structure 54 supported by the bottom wall 28 of the housing. More specifically, drum 53 is provided with coaxial journals 56, 58 which are rotatably supported by coaxial bearings 60, 62 on structure 54. See FIGS. 3 and 8. Torsion spring 55 on drum 53 operates between gear segment 52 and structure 54 to urge said gear segment in clockwise direction as viewed in FIGS. 5 and 6.

Each gear segment 52 is provided with a flange 64 which extends radially outwardly from the axis of rotation of journals 56, 58. Engageable with flange 64 an outwardly projecting slide 66 which rides in a guide channel 68 on sleeve 30. A spring 70 urges the slide downwardly in channel 68 and when the selector control is manually rotated to select an individual representation 32 and is then manually depressed, slide 66 engages flange 64 of the gear segment that is related to that representation, thereby camming or otherwise pushing flange 64 and causing the gear segment to rotate about its axis of rotation. Since gear 50 is in engagement with gear segment 52, rotation of the latter causes rotation of the former. Specifically, the circumferential dimension of gear 50 relative to the angular movement of gear segment 52 is such that a downward stroke of the selector control will cause a 180 degree rotation of gear 50. And since gear 50 is fixed relative to an individual rotatable element 14, that rotatable element will also rotate 180 degrees to expose the three-dimensional representation 32*a* thereon.

Figure 4:
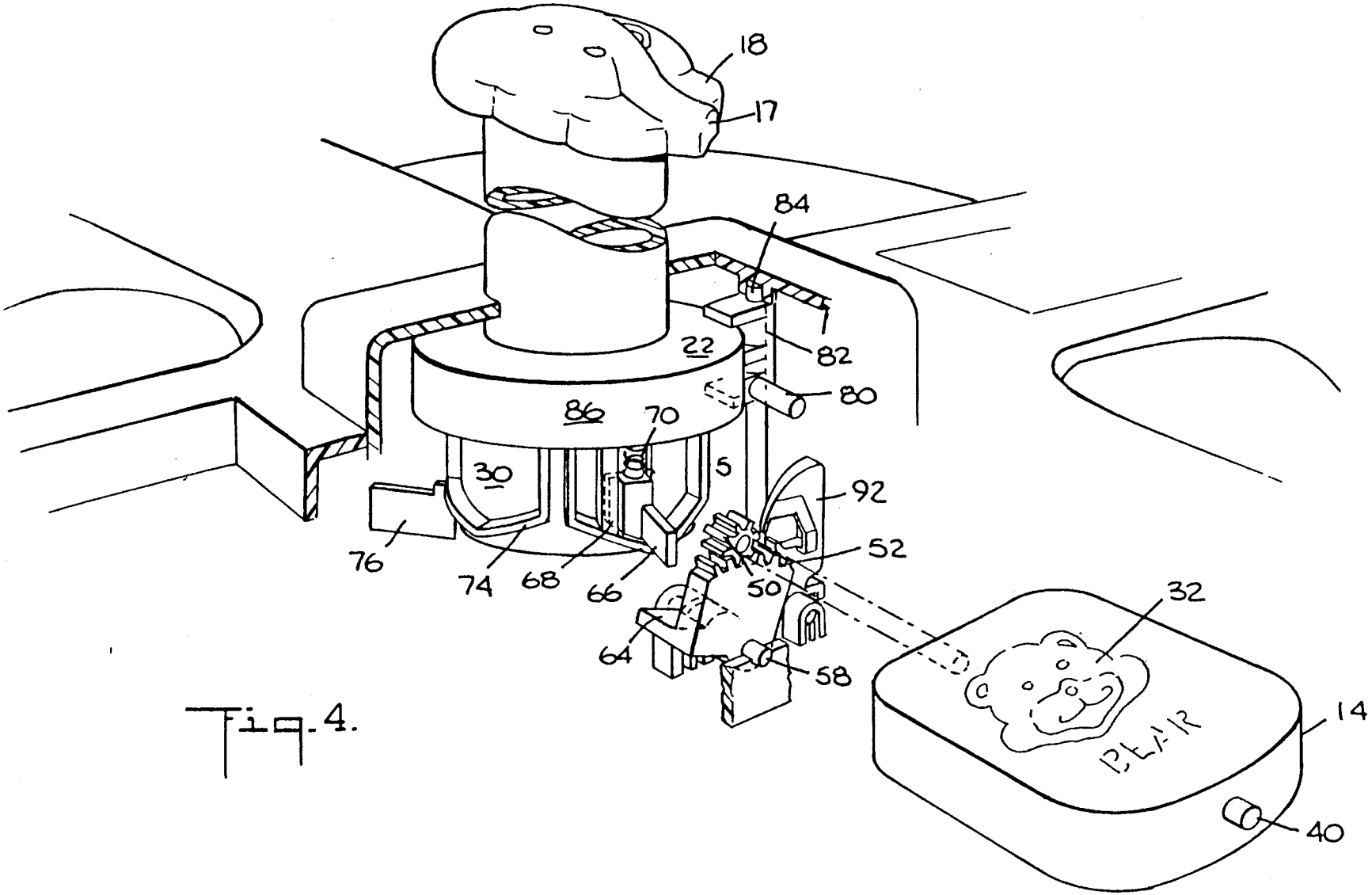
FIG. 4 is a fragmentary, partly exploded, partly sectioned, view of said preferred embodiment, showing the mechanism for rotating the graphics-bearing elements.

The foregoing description of the action of gears 50 and 52 applies to each individual set of those gears and the individual rotatable element 14 to which it is connected. All that is required to actuate an individual set of gears 50, 52 and the related rotatable element 14, is to rotate selector control 16 until it points to the selected rotatable element and then to depress said selector control as described. For this purpose, selector control 16 should be provided with a conventional pointer, or it may be given a directional configuration. As shown in FIG. 4, for example, cap 18 of the selector control defines a molded elephant head, the elephant's trunk 72 extending radially of the axis of rotation of the selector control, and functioning as a pointer.

To assure operational registration of the elephant's trunk with the selected rotatable element, a funnel-shaped guide 74 for each rotatable element is provided on sleeve 30, and a vertically extending spline 76 is provided at each structure 54. When the elephant's trunk (or any other pointer) is pointed toward a selected rotatable element 14, and the selector control 16 is then manually depressed, guide 74 will, to the extent necessary, rotationally cam itself and the selector control to align guide channel 78 with spline 76. When said spline enters said channel, the selector control is operationally registered with the selected rotatable element.

Retaining means are provided for retaining the selected three-dimensional representation in exposed position until it is desired to expose another three-dimensional representation. Such retaining means include a horizontal actuating pin 80 extending from a slide 82 riding on a vertical rod 84. The slide is keyed to annular rim 86 on annular flange 22 so that vertical (axial) movement of the selector control, at any angular position of said selector control, will cause corresponding movement of said slide. See FIGS. 4 and 8.

The retaining means also include a hook mechanism 90 shown in FIGS. 9–12. Specifically, this mechanism has a hook 92 which is pivotally mounted on housing wall 28 by means of stud pins 94 journaled in bearings 95. A spring 96, acting between a bracket 98 attached to the hook and a suitable support in the housing, urges the hook to pivot in clockwise direction, as viewed in FIGS. 9–12, about the common axis of pins 94.

When the selector control is moved manually downwardly, actuating pin 80 will engage curved upper cam surface 100 on the hook and cam the hook backwardly, that is, in counterclockwise direction as viewed in FIG. 9, against the action of spring 96. When said actuating pin clears the pointed end of the hook, spring 96 will pull the hook forwardly, that is, in clockwise direction, as viewed in FIG. 10. Actuating pin 80 can now be hooked in the crook of the hook, between upper edge 102 and inclined side edge 104. At this step in the sequence, the selector control cannot return to its original position, and the selected three-dimensional representation will be retained in exposed position.

To operate the selector control in order to expose another three-dimensional representation, the selector control is further depressed to move actuating pin 80 from its position in FIG. 10 to its position in FIG. 11. The hook will now swing forwardly (in clockwise direction as viewed in FIG. 11) from its phantom position to its solid line position, responsive to the action of spring 96. The free end of the actuating pin will now abut a cam-shaped ramp 106 which is inclined from the right side to the left side of the hook as viewed in FIG. 11. The actuating pin is now free to disengage the hook by riding up the cam-shaped ramp to its position in FIG. 12.

What causes this upward movement of actuating pin 80 is spring action as indicated in FIG. 8. As above described, spring 24 is biased to raise the selector control to its retracted (inactive) position, or to support it in that position. Consequently, when the selector control is released after it is depressed to move actuating pin 80 to its FIG. 11 position, spring 24 takes over to thrust the selector control upwardly to its retracted position, thereby moving the actuating pin from its FIG. 11 position, up the cam-shaped ramp to its FIG. 12 position, and thence back to its FIG. 9 position. This action of the actuating pin may require tilting of the hook in order to clear it. Such tilting of the hook, on an axis perpendicular to the axis of the stud pins, is shown in FIG. 12. Tilting of the hook is made possible by the elongated vertical dimension of bearings 95 and the elasticity of spring 96.

Figure 6:
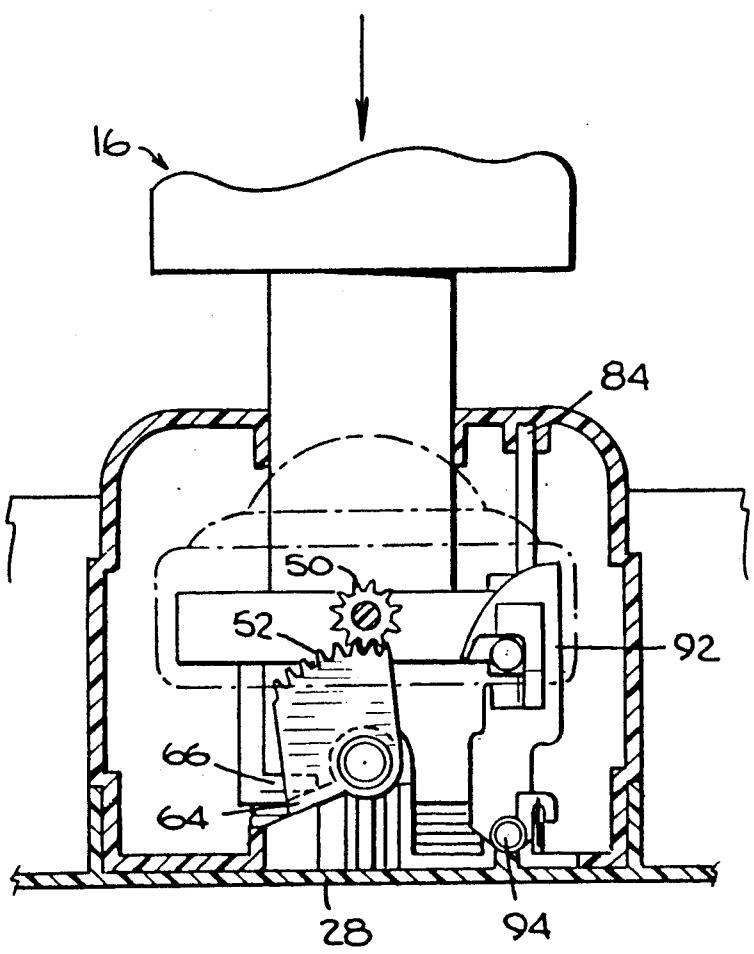
FIG. 6 is a view similar to that of FIG. 5, but showing the position of the rotating mechanism resulting from actuation by the selector control.
Figure 5:
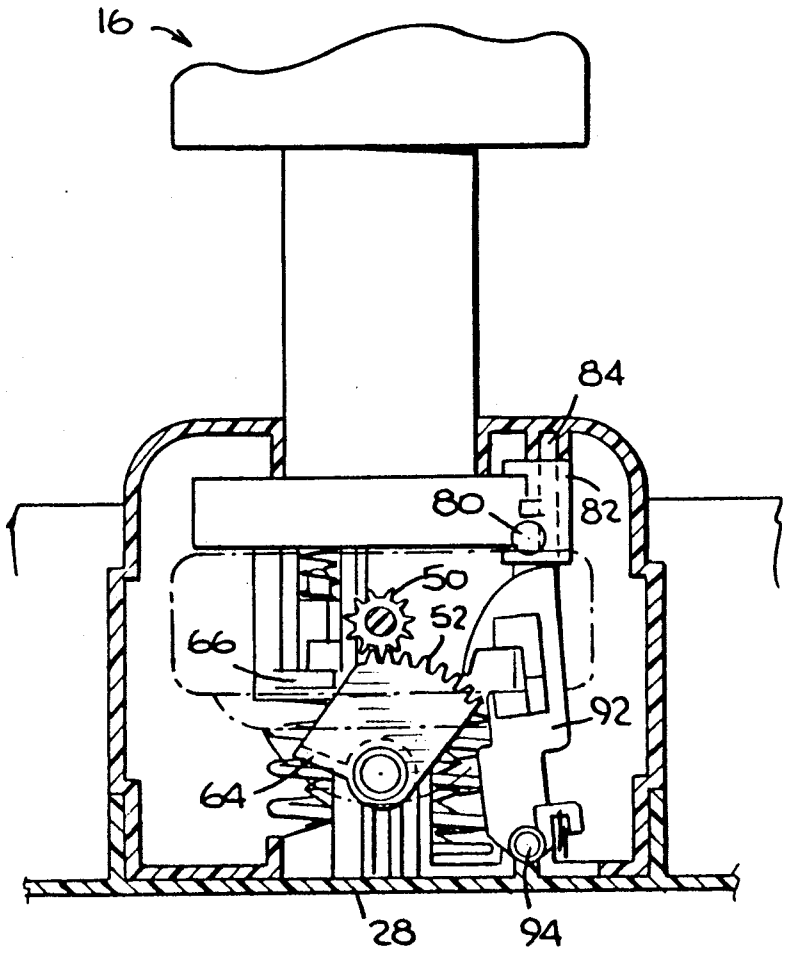
FIG. 5 is a fragmentary side view of said embodiment, partly in vertical section, showing the position of the rotating mechanism prior to actuation by the selector control.

The result of this action is to enable the selected rotatable element 14 to return from its FIG. 6 position wherein its three-dimensional representation 32 is exposed, to its FIG. 5 position wherein said representation is concealed. What causes this retraction is the disengagement of outwardly projecting slide 66 from flange 64 on the gear segment, and the action of torsion spring 55 on said gear segment.

It will also be noted (in FIG. 8) that centered within the selector control cylinder 16*a* is a sound maker 110 comprising a spring-expanding accordian-type bellows with a sound producer. This bellows rests on a pedestal 112 ad its upper end abuts an embossment 114 projecting downwardly from cap 18. Sound is now produced when the selector control is pressed downwardly. If desired, it may be a double-acting sound maker, producing sound when it expands. In either case, this spring-expanding bellows may be used in place of spring 24 to provide spring action upon the selector control.

Since the foregoing is descriptive of a preferred embodiment of the invention, it will be understood that the principles of the invention, as herein claimed, are intended to apply to all other embodiments of the invention.

We claim:

1. A multiple graphics selection toy comprising:

a. A plurality of graphics-bearing elements, b. said graphics-bearing elements being individually mounted in a common housing for individual rotation between a position in which the graphics are concealed and a position in which the graphics are revealed, c. rotary drive means connected to said graphics-bearing elements for individually rotating them between said positions, and d. a selector control connected to said rotary drive means to selectively rotate the individual graphics-bearing elements between said positions and thereby to selectively conceal or reveal the graphics on the individual graphics-bearing elements.

2. A multiple graphics selection toy in accordance with claim 1, wherein:

a. the common housing is provided with a plurality of windows, one for each graphics-bearing element, b. said graphics-bearing elements being individually mounted in said windows for individual rotation therein between the positions in which the graphics are concealed and revealed.

3. A multiple graphics selection toy in accordance with claim 1, wherein:

a. said rotary drive means is supported in said housing, b. said rotary drive means including a plurality of rotary drive gears, one for each graphics-bearing element, and c. including a plurality of rotary driven gears fixed to said graphics-bearing elements, coaxially therewith, one for each graphics-bearing element, d. said rotary drive gears individually engaging said rotary driven gears, and e. said selector control being selectively engageable with said rotary drive gears to individually operate them and thereby to individually drive said rotary driven gears, f. whereby said graphics-bearing elements are rotated between said positions.

4. A multiple-graphics selection toy in accordance with claim 3, wherein:

a. the selector control is rectilinearly movable along its longitudinal axis from an inoperative to an operative position and back, b. said selector control being also rotatably movable about said longitudinal axis, c. said rotary drive gears being rotatably movable about axes of rotation which are perpendicular to said longitudinal axis, d. individual radial lever arms being connected to said rotary drive gears, and e. a pusher being connected to said selector control for selective actuating engagement with said radial lever arms, f. whereby rotary movement of said selector control about said longitudinal axis enables it to select an individual graphics-bearing element for rotation from graphics concealing position to graphics revealing position, g. thereby selecting the rotary drive gear and rotary driven gear which are individual to said graphics-bearing element, h. whereby manual pressure on said selector control causes it to move from its inoperative to its operative position along said longitudinal axis, thereby causing said pusher to actuate the radial lever arm of the selected rotary drive gear, and i. thereby causing rotation of said selected rotary drive gear and the rotary driven gear which it drives, j. whereby the selected graphics-bearing element is caused to rotate from graphics concealing position to graphics-revealing position.

5. A multiple-graphics selection toy in accordance with claim 4, wherein:

a. a compression spring is provided between the selector control and the housing, b. said compression spring biasing said selector control against movement from its inoperative to its operative position, c. said compression spring being thereby adapted to return said selector control to its inoperative position.

6. A multiple-graphics selection toy in accordance with claim 5, wherein:

a. torsion springs are connected to said rotary drive gears to bias the graphics-bearing elements, through said rotary driven gears, from graphics-concealing, position to graphics-revealing position, b. said torsion springs being adapted to cause said graphics-bearing elements to rotate back to graphics-concealing position from graphics-revealing position.

7. A multiple-graphics selection toy in accordance with claim 6, wherein:

a. retaining means are provided in said housing to retain said graphics-bearing elements in graphics-revealing position against the action of said torsion springs and b. releasing means to release said graphics-bearing elements from said retaining means, c. said releasing means being actuated by said selector control.

8. A multiple-graphics selection toy in accordance with claim 7, wherein:

a. the retaining means includes an actuator pin connected to the selector control, and b. a hook pivotally movable in said housing, c. said pin being engageable with said hook when the selector control is axially moved from inoperative to operative position against the action of said compression spring, d. thereby retaining said selector control in operative position, e. whereby the selector control retains the selected graphics-bearing element in graphics-revealing position.

9. A multiple-graphics selection toy in accordance with claim 8, wherein:

a. the hook is tiltable on an axis perpendicular to its pivotal axis, b. cam means being provided between the hook and the actuator pin, c. whereby the pin cams the hook and causes it to tilt to disengage the pin when the selector control moves axially from operative to inoperative position under the action of said compression spring.

10. A multiple-graphics selection toy in accordance with claim 4, wherein:

a. the selector control is centrally located relative to the graphics-bearing elements, b. said graphics-bearing elements being angularly spaced from each other about the longitudinal axis of the selector control, c. said selector control having radial pointer means adapted to point to the individual graphics-bearing elements when the selector control is rotated about its longitudinal axis, d. whereby the pusher on the selector control is movable into actuating engagement with the radial lever arm of the rotary drive gear that drives the rotary driven gear of a selected graphics-bearing element.

11. A multiple-graphics toy in accordance with claim 10, wherein:

a. registering means is provided to selectively register the selector control pusher with the individual radial lever arms of the rotary drive gears, b. said registering means comprising funnel-shaped guides on the selector control, one guide for each radial lever arm, c. each guide having a centrally-disposed channel paralleling the longitudinal axis of the selector control, d. splines supported in the housing, one for each radial lever arm, e. said splines paralleling the longitudinal axis of the selector control, f. said splines being adapted to cam themselves against the guides and into the channels when the selector control moves axially from inoperative to operative position, g. whereby the selector control pusher is aligned with the radial lever arm of a selected graphics-bearing element, h. thereby causing said selected graphics-bearing element to rotate to graphics-revealing position.

12. A multiple-graphics toy in accordance with claim 4, wherein:

a. a sound-maker is provided between the selector control and the housing, b. whereby sound is produced when the selector control is rectilinearly moved in at least one direction along its longitudinal axis.

* * * * *